US005921542A

United States Patent [19]

Ohno et al.

[11] Patent Number: 5,921,542

[45] Date of Patent: Jul. 13, 1999

[54] SHEET FEEDING DEVICE HAVING A FRICTIONAL SEPARATING MEMBER

[75] Inventors: Michinobu Ohno, Osaka; Hiroyuki Nagao, Yumabe-gun, both of Japan

[73] Assignee: Sharp Kabushiki Kaisha, Osaka, Japan

[21] Appl. No.: 09/056,890

[22] Filed: Apr. 8, 1998

[30] Foreign Application Priority Data

Apr. 10, 1997 [JP] Japan ..... 9-091259

[51] Int. Cl.[6] ..... B65H 3/52; B22B 4/00

[52] U.S. Cl. ..... 271/121; 156/344

[58] Field of Search ..... 271/127, 121, 271/160, 167, 8.1; 156/306.3, 344

[56] References Cited

FOREIGN PATENT DOCUMENTS 7-104398 4/1995 Japan .

*Primary Examiner*—William E. Terrell
*Assistant Examiner*—K W Bower

[57] ABSTRACT

A frictional separating member is provided corresponding to a position at which sheets loaded on a stacking plate are fed by a pickup roller. Formed in the position where the frictional separating member is mounted is a hollowed portion for embedding this frictional separating member. The frictional separating member is adhesively attached to the hollowed portion, with adhesive via a flexible sheet-like support. The sheet-like support is extended further from where the frictional separating member is provided. This extended portion is held as a free end which is not adhered but is positioned in a second cavity adjacent to the hollowed receptacle of the frictional separating member. A projection is formed in order to partition the receptacle cavity to which the frictional separating member is mounted and the second cavity so as to keep the handle portion free within the second cavity.

8 Claims, 13 Drawing Sheets

SHEET FEEDING DEVICE HAVING A FRICTIONAL SEPARATING MEMBER

BACKGROUND OF THE INVENTION (1) Field of the Invention

The present invention relates to a sheet feeding device for use in an image forming apparatus such as a copier, printer, plain paper facsimile machine, etc., which feeds sheets on which the image is formed, to the image forming unit, more particularly relating to a sheet feeding device having a frictional separating member for separating one sheet from a stack of sheets.

(2) Description of the Prior Art

In a copier, printer or plain paper facsimile machines, etc., a desired image is formed on a sheet, and this sheet is discharged externally from the apparatus. In this case, the sheet is automatically or manually dispensed to the image forming unit from the sheet feeder portion. Therefore, a stack of sheets is placed on a stacking plate provided on a tray or cassette etc., and the sheets are separated and delivered one by one to the image forming unit.

Further, a copier or facsimile machine needs to read the image of an original document and hence may include a sheet feeding mechanism which is similar to that used for the sheets for image forming, in order to feed original documents sheet by sheet from a stack of documents on the original stacking tray etc.

Illustratively, the sheet feeding device provided for a copier etc., has the mechanism as shown in FIG. 1, which shows a paper feed cassette removably provided to the paper feeder portion of a copier etc. This paper feed cassette designated at 100 comprises a casing 101; regulator plates 102 for constraining both sides of the sheets inside casing 101; and a rear end regulator plate 103 for constraining the rear end of the sheets with respect to the sheet feed direction. These regulator plates 102 and 103 can be positioned in accordance with the size of the sheets.

Sheets are placed on the area partitioned by the above regulator plates 102 and 103, and a stacking plate 104 is provided in the area where the sheets are loaded. This stacking plate 104 is axially supported at supporting portions 105, pivotally relative to casing 101 of paper feed cassette 100. This configuration permits stacking plate 104 to pivot itself or move its front part, with respect to the paper feed direction, up and down.

In order to feed the sheet from casing 101 of paper feed cassette 100, stacking plate 104 is lifted up, as sectionally shown in FIG. 2, to the designated position by use of a lifting member 106 provided on the copier body side. Provided at the position to where the stack of sheets is raised is a pick up roller 107 for delivering sheets P from the stack. Sheets P delivered out by pickup roller 107 are fed one by one by the action of a feed roller 108 and separation roller 109. Provided in the bottom of casing 101 of paper feed cassette 100 is an opening 110 which allows the aforementioned lifting member 106 to raise stacking plate 104.

In the thus configured paper feed cassette 100, when paper feeding is instructed, lifting member 106 raises stacking plate 104. With this movement, a stack of sheets P on stacking plate 104 is raised to the position where the stack opposes (the stack is pressed against) pickup roller 107, so that the sheets are delivered out by the rotation of pickup roller 107. At this moment, if two or more sheets are delivered to the pressure nip between paper feed roller 108 and separation roller 109, only the topmost sheet P is drawn by the function of paper feed roller 108 and separation roller 109. Specifically, separation roller 109 can rotate in a direction opposite to the paper feeding direction, or can rotate in the same direction when it is pressed against paper feed roller 108 and rotate by way of a torque limiter etc. which will not allow the separation roller to rotate when sheet P is delivered out. Therefore, the sheets under the topmost sheet are inhibited from being delivered by means of separation roller 109, thus implementing sheet-by-sheet feeding.

In this case, in order to inhibit the whole stack of sheets P placed on stacking plate 104 from being delivered out toward paper feed roller 108 by pickup roller 107, a frictional separating member 111 is usually provided on stacking plate 104. This frictional separating member 111 is disposed on the surface of stacking plate 104 at a position corresponding to the aforementioned pickup roller 107. Frictional separating member 111 may be fixed in an embedded manner in stacking plate 104, if required. Therefore, frictional separating member 111 is provided with its top slightly projected from the level of stacking plate 104.

FIG. 3 shows a configuration in which stacking plate 104 in paper feed cassette 100 is shared with the bottom plate of casing 101 of paper feed cassette 100. In this configuration, a pickup roller 107 is provided so as to move up and down and thereby press sheets P stacked on stacking plate 104. Accordingly, when the paper is fed, pickup roller 107 moves down to the stack of sheets P and starts delivery of topmost sheet P which is being pressed thereby. For this operation, in order to facilitate the delivery of sheet P toward feed roller 108, the inward facing panel (in the sheet feed direction) 112 of casing 101 of paper feed cassette 100 is angled forming an upward slope, or inclined toward feed roller 108. In this paper feed cassette 100, stacking plate 104, which is formed as the bottom plate of casing 101 to have sheets P stacked thereon, has a frictional separating member 111 embedded therein.

Here, as shown in FIGS. 2 and 3, the frictional separating member provided on the surface of the stacking plate will be reduced in its frictional coefficient and deformed by a large number of feed operations of sheets, i.e., some thousand or some tens of thousands of sheets, or by the weight of the sheets as well as by repeated pressing actions of pickup roller 107. This reduction of the friction or the deformation will cause a group of sheets to be picked up and fed at a time, by pickup roller 107 to feed roller 108. A number of sheets thus fed to the pressure nip between feed roller 108 and separation roller 109 will cause feeding failure, in particular resulting in paper jamming, or disability of sheet feeding.

For this reason, it was necessary to change the frictional separating member 111, periodically. For example, the copier was adapted to give the message, i.e., to inform the user to replace the frictional separating member after a predetermined number of sheets have been fed. Even with this message, the replacement itself was very troublesome for the user, and in actual fact, a maintenance person needed to be called for the replacement.

Since frictional separating member 111 is usually embedded in stacking plate 104 etc. as shown in FIG. 3, the removal of it from stacking plate 104 is very troublesome. In particular, frictional separating member 111 is stuck fast to stacking plate 104, so that the removal by peeling and other handling are troublesome. When it is peeled off, frictional separating member 111 may be broken in part, and might remain attached in part at its original position. Therefore, if a new frictional separating member 111 is applied without complete removal, the surface becomes irregular undulating up and down over the remaining parts of the old frictional separating member, becoming the cause of defects in sheet feeding.

SUMMARY OF THE INVENTION

In view of the problems described above, it is therefore an object of the present invention to provide a sheet feeding device which allows easy replacement of the frictional separating member to be mounted to the stacking plate on which a stack of sheets is placed.

It is another object of the invention to allow easy peeling of the frictional separating member as well as facilitating easy attachment thereof.

The present invention has been devised in order to achieve the above object, and is configured as follows:

In accordance with the first aspect of the invention, a sheet feeding device includes:

a frictional separating member for preventing a multiple number of stacked sheets from being fed together in a feeding unit, the separating member being disposed in a stacking plate on which a stack of sheets is loaded for delivery; and a sheet-like support for fixing the frictional separating member and retaining it at a correct position on the stacking plate, and is characterized in that the support has a handle portion to be a free end which is not held on the stacking plate.

In accordance with the second aspect of the invention, the sheet feeding device having a frictional separating member of the above first feature, is characterized in that a hollowed portion having a receptacle cavity for embedding the frictional separating member and a cavity for placing the handle portion to be a free end therein is provided in the stacking plate.

In accordance with the third aspect of the invention, the sheet feeding device having a frictional separating member of the above second feature is characterized in that the hollowed portion has a projected portion which partitions the receptacle of the frictional separating member and the portion in which the handle portion to be a free end is positioned so that the handle portion juts out over the projected portion.

In accordance with the fourth aspect of the invention, the sheet feeding device having a frictional separating member of the above second feature is characterized in that the hollowed portion has a passage hole in the area where the handle portion of the sheet-like support is positioned, and the handle portion is adhesively retained in the hollowed portion or the undersurface of the stacking plate in order to constrain the movement of the distal end of the handle portion.

In accordance with the fifth aspect of the invention, a sheet feeding device includes:

a frictional separating member for preventing a multiple number of stacked sheets from being fed together in a feeding unit, the separating member being disposed in a stacking plate on which a stack of sheets is loaded for delivery; and a sheet-like support for fixing the frictional separating member and retaining it at a correct position on the stacking plate, and is characterized in that the sheet-like support is extended up to the vicinity of the feeding unit which further feeds the delivered sheet in the sheet feeding direction, and an extended end is formed to be a handle portion as a free end which is not held on the stacking plate.

In accordance with the sixth aspect of the invention, the sheet feeding device having a frictional separating member of the above fifth feature is characterized in that an extended portion of the sheet-like support is held in a trough between projection ribs formed in the inward-side face for guiding the fed sheet.

In accordance with the seventh aspect of the invention, a sheet feeding device includes:

a frictional separating member for preventing a multiple number of stacked sheets from being fed together in a feeding unit, the separating member being disposed in a stacking plate on which a stack of sheets is loaded for delivery; and a sheet-like support for fixing the frictional separating member and retaining it at a correct position on the stacking plate, and is characterized in that the sheet-like support is extended in the sheet feeding direction so that an extended portion is folded at the front edge of the stacking plate and retained also by the undersurface of the stacking plate while the distal end of the extended portion is formed to be a handle portion of a free end which is not held on the stacking plate.

In accordance with the eighth aspect of the invention, the sheet feeding device having a frictional separating member of the above seventh feature is characterized in that the front edge of the stacking plate at which the sheet-like support is folded is formed with a cutout.

The operations of the invention thus configured will be explained hereinbelow.

In the first configuration, the frictional separating member is held on the stacking plate via a sheet-like support on which the frictional separating member is fixed, instead of being applied directly on the stacking plate. Further, since the sheet-like support has a handle portion provided as a free end, it is possible to strip off the support from the stacking plate by holding the handle portion with fingers etc.

The second configuration may be as shown in FIGS. 8A and 8B, for example. Accordingly, it is possible to insert the fingers etc., to cavity 69*b* of the hollowed portion so as to easily hold the handle portion 71*a* to thereby strip off sheet-like support 71 from hollowed portion 69. Also in attaching the frictional separating member, sheet-like support 71 having the frictional separating member fixed thereon can be adhesively attached to hollowed portion 69 with adhesive 72. In this case, hollowed portion 69 functions as the positioning, thus enabling easy attachment of the frictional separating member. Further, if frictional separating member 70 is provided in an embedded manner to the hollowed portion, it is possible to readily remove it by holding the handle portion of sheet-like support 71, as stated heretofore.

In the device in accordance with the above third configuration, when a projected portion 69*c*, for example, is formed as shown in FIGS. 8A and 8B, it is possible to position the handle portion 71*a* so as to rise up, by the projected portion 69*c*. This configuration facilitates the user to hold the handle portion and hence perform easier replacement.

Next, in the fourth configuration shown in FIGS. 10A and 10B to FIGS. 12A and 12B, provision of a passage hole 69*d* enables the user to hold the handle portion more easily. Further, in order to constrain the movement of the distal end of a handle portion 71*a*, the handle may be adhesively attached to the hollowed portion or the undersurface of stacking plate 61. Thus, the handle portion as a free end can be prohibited from moving, or projecting to the sheet feeding space. Consequently, it is possible to prevent the handle portion from interfering with the sheet feeding action.

In the fifth configuration shown in FIGS. 13 and 14, one end of sheet-like support 71 having frictional separating member 70 fixed thereon is extended in the sheet feeding direction so that the extension functions as the sheet guide to the pressure nip of feed roller 68 which further feeds the delivered sheet.

Further, in accordance with the sixth configuration, the holding length of support 71 can be made longer in the above fifth one, making it possible to eliminate the risk of accidental peeling of the frictional separating member during the sheet feeding operation. Further, since the sheet-like support can be held between projection ribs serving as the sheet guide, there is no need to provide an extra holding portion in the stacking plate.

In the seventh configuration, when, for example, stacking plate 61*a* is supported pivotally as shown in FIGS. 15A and 15B, handle portion 71*a* of sheet-like support 71 may be positioned in the way on the sheet feed path because the handle has free end. In this configuration, however, since the sheet-like support is folded along the edge of the stacking plate to the undersurface and held thereby, it is possible to eliminate a risk that the handle portion as a free end might interfere with the sheet feeding region. Further, it is possible to broaden or lengthen the holding range of the sheet-like support, thus making it possible to eliminate the risk of accidental peeling of the frictional separating member during the sheet feeding operation.

In the eighth configuration, since a cutout 76 is formed as shown in FIGS. 16A and 16B, this cutout 76 functions as the marker or the positioning element when frictional separating member 70 is provided in a position where stacking plate 61 is flat. Further, the sheet-like support is folded along the edge of the cutout portion to the undersurface of the stacking plate, facilitating easy holding.

DESCRIPTION OF THE PREFERRED EMBODIMENTS

The embodiment of the invention will hereinafter be described with reference to the accompanying drawings.

Figure 4:
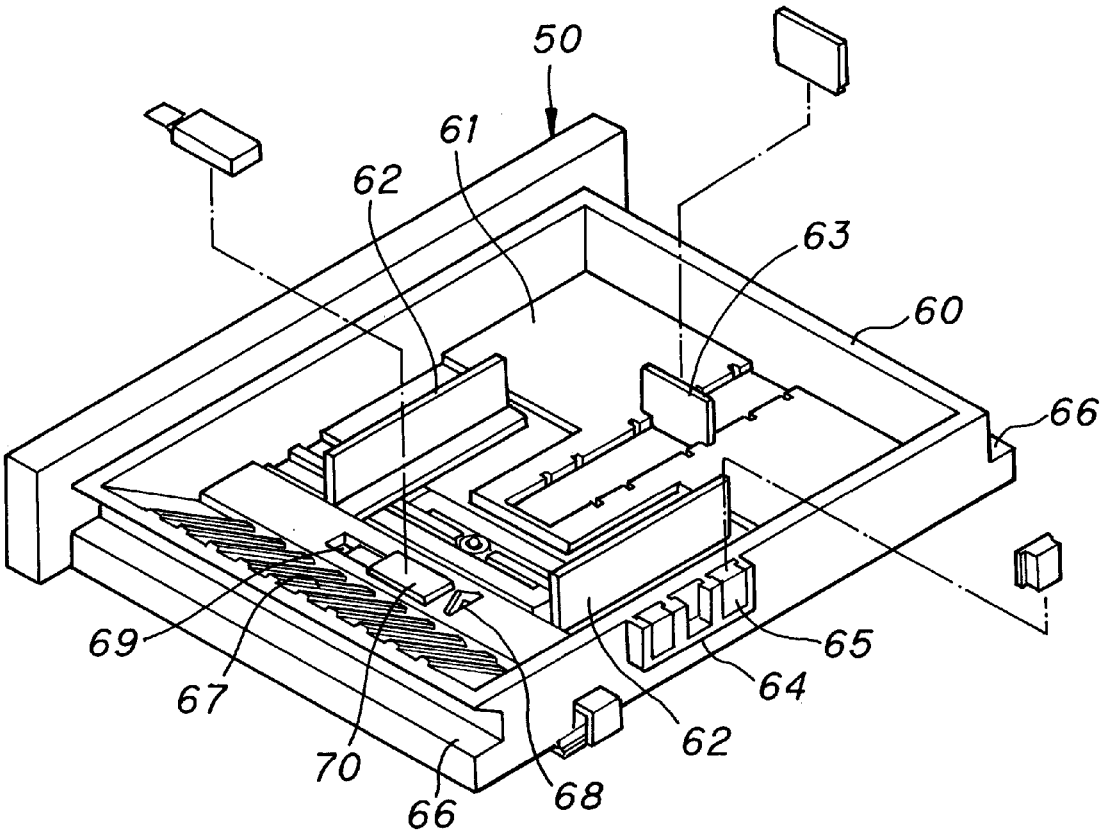
FIG. 4 is a perspective view showing one embodiment of a paper feed cassette constituting a sheet feeding device of the invention.
Figure 5:
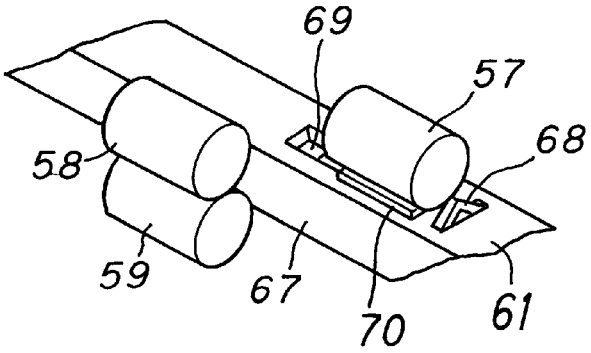
FIG. 5 is a perspective view showing the sheet feeder portion in the sheet feeding device shown in FIG. 4.
Figure 6:
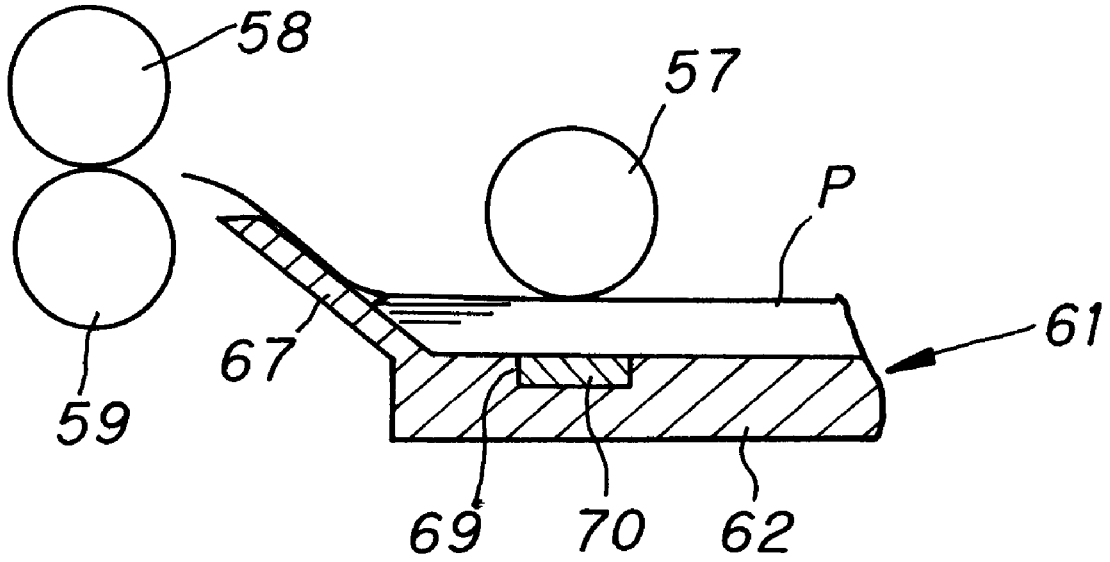
FIG. 6 is a sectional view showing the sheet feeding portion shown in FIG. 5.
Figure 7:
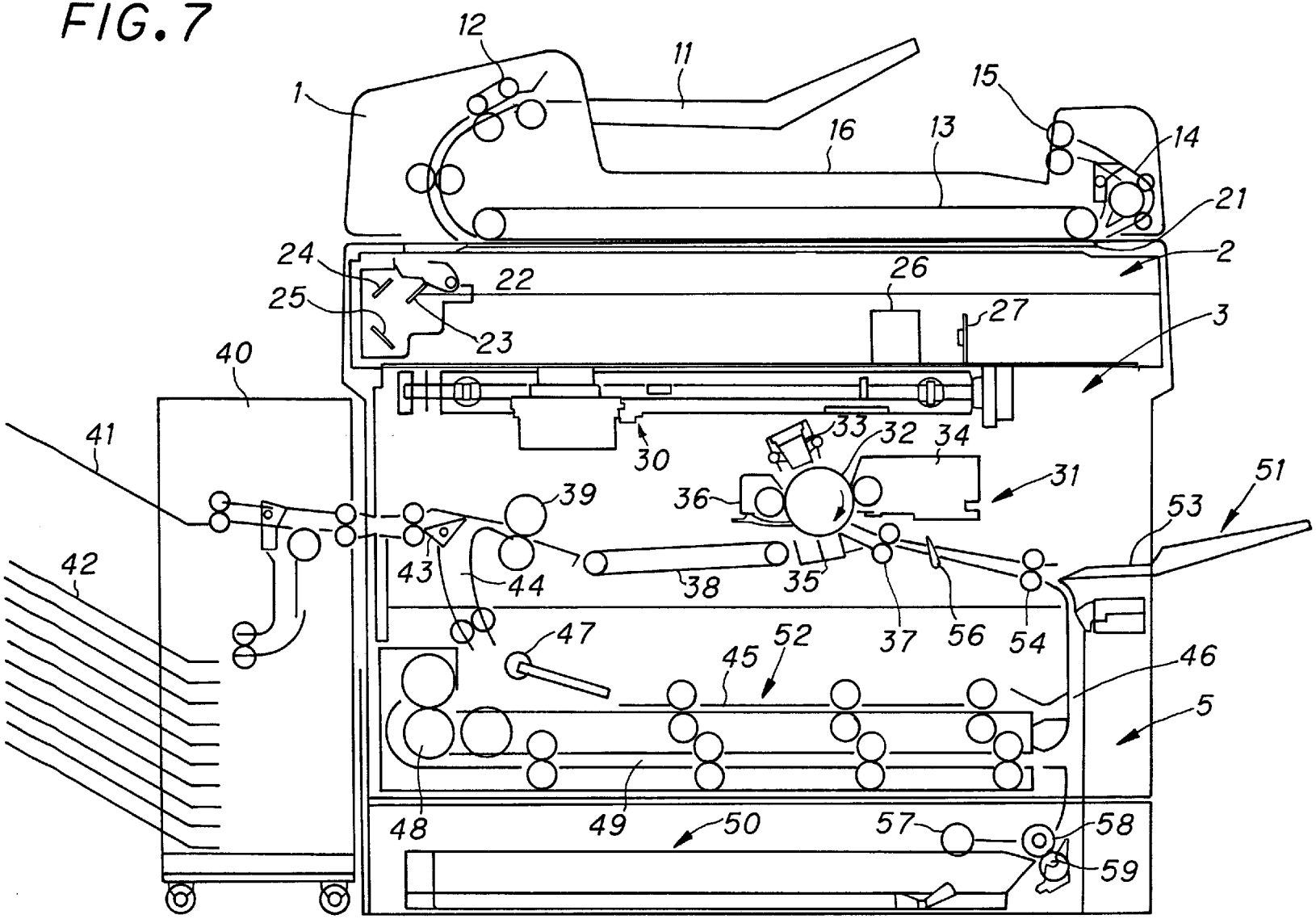
FIG. 7 is a sectional view showing an example of the interior configuration of a digital copier having a sheet feeding device of the invention.

FIG. 4 is a perspective view showing the configuration of a paper feed cassette constituting a sheet feeding device of the invention. FIG. 5 is a perspective view showing the feeder portion including a pickup roller, feed roller etc. in the sheet feeding device. FIG. 6 is a sectional view of FIG. 5. FIG. 7 is a sectional view showing the interior configuration of a digital copier as an example of an image forming apparatus having the paper feed cassette consisting the sheet feeding device shown in FIG. 4.

First, before the description about the configuration of the sheet feeding device of the invention, a digital copier having the sheet feeding device of the invention shown in FIG. 7 will be explained. The sheet feeding device of the invention can be applied not only to copiers but can also be used as the sheet feeder of a printer etc. as well as being applied as it is to the sheet feeder of originals in a copier or facsimile machine.

As shown in FIG. 7, a digital copier includes: an automatic document feeder 1 disposed on the top for performing automatic feeding control of sheet-like originals; an image input unit (scanner) 2 disposed below the feeder for reading the image of a sheet-like original automatically fed by automatic document feeder 1 or the image of an original placed on the transparent original table; and an image forming apparatus 3 disposed further below, having a laser output unit 30 for optically outputting the image which has been picked up by the scanner and an image forming unit 31 for developing the optically formed image by the exposure of laser output unit 30, into a visual image.

Image forming unit 31 includes: a photoreceptor 32 disposed in the center and rotating in the direction of the arrow in the drawing; a charger 33 for uniformly charging the photoreceptor surface; a developing unit 34 for developing the electrostatic latent image formed after the exposure, by the laser output unit, of the picked up image corresponding to the original; a transfer device 35 for transferring the toner image formed on the photoreceptor to the sheet which has been fed by an aftermentioned sheet feeding device; and a cleaning unit 36 for cleaning the leftover toner after transfer.

Laser output unit 30 for irradiating photoreceptor 32 with the picked up image of the original is a conventional well-known type, which includes of a semiconductor laser; a driver for on-off driving of the laser in accordance with the image data; a deflector for deflecting the laser beam emitted from the semiconductor laser to predetermined positions; and various lenses for focusing the laser beam in order to irradiate photoreceptor 32 with the laser beam.

Scanner 2 for inputting the image data to laser output unit 30 includes: an exposure lamp 22 disposed below original table 21 for illuminating the original; an optical system composed of mirrors 23, 24 and 25 appropriately reflecting the reflected light from the original; a lens 26 focusing the reflected light from the original; and a CCD 27 disposed at the focusing position of lens 26 for image pickup. Mirror 23 and exposure lamp 22 are driven integrally traveling along original table 21 at a constant speed while the second scanning portion of mirrors 24 and 25 is made to travel at half the speed of the aforementioned constant speed. The image of the original is successively focused line-wise onto CCD element 27. The thus photoelectrically converted image signal through CCD element 27, i.e., the pickup signal, will be output line by line.

In order to set an original onto original table 21 constituting scanner 2, automatic document feeder 1 is provided on the top of original table 21. This automatic document feeder 1 includes: an original stacking tray 11 for receiving sheet-like original documents; a feeder portion 12 for feeding a sheet-like original from original stacking tray 11; a conveyer belt 13 disposed opposing original table 21 for conveying the sheet from feeder portion 12 and setting it at the correct position on original table 21; a discharging portion 14 for discharging a sheet-like original upside down after image pickup; a discharging roller 15 for transporting the discharged sheet-like original to a discharge tray 16 formed below stacking tray 11. This automatic document feeder 1 is configured so as to be able to open relative to original table 21, so that the image of an original of a book etc. can be manually set on original table 21 instead of performing automatic feeding of sheet-like originals.

In the thus configured digital copier, when a sheet-like original is set on original table 21 by, e.g., automatic document feeder 1, scanner 2 scans the original to pick up the image information of the original. The thus obtained image data is supplied to laser output unit 30 which in turn outputs laser beam onto the surface of photoreceptor 32 which has been uniformly charged by charger 33. In this way, an electrostatic latent image corresponding to the original image is formed on the surface of photoreceptor 32. This static latent image is then developed at developing unit 34 where the toner as a coloring matter is applied to produce a visual image.

The toner image formed on the surface of photoreceptor 32 is transferred to the sheet which is appropriately conveyed from the sheet feeding device, by the function of transfer device 35. The sheet has been previously conveyed to the position of a resist roller 37, and is delivered at a time synchronized with the rotational position of photoreceptor 32, by means of resist roller 37 to the transfer station (image forming station) opposing transfer device 35.

The sheet after transfer is separated from the surface of photoreceptor 32, and is conveyed by suction conveyer belt 38 into heat-fixing roller 39. The toner image formed on the sheet is fixed thereto as a permanent image by the passage through heat-fixing roller 39. Then, the sheet is discharged outside the copier. On the discharge side of the copier body, a sorter 40, for example, can be removably attached which distributes the discharged sheets as required. Sorter 40 is of a conventionally well-known type, and discharges the sheets to a topmost discharge tray 41 if sheet sorting is not needed. When sheet sorting is needed, the sheets are guided and discharged so as to be distributed to multiple number of sort trays 42 arranged in layers below discharge tray 41.

Next, description will be made of the sheet feeding device of the invention for feeding sheets to the aforementioned resist roller 37.

Sheet feeding device 5 is located in the lower part of the copier body, and includes: a paper feed cassette 50 provided detachably in the copier body (in particular, it can be detached draw-wise in a forward direction in the drawing); a manual paper feeder 51 arranged projectively on the right-hand side of the copier body; and an intermediate sheet feeding mechanism 52 disposed between image forming unit 31 and paper feed cassette 50 for re-feeding the sheet having an image once formed thereon to the image forming unit.

This intermediate sheet feeding mechanism 52 is connected to a branch path 44, which is branched, at a path converting claw 43, from the discharge portion of sheets discharged from fixing roller 39. This branch path 44 is connected through a straight-through conveying path 45 for conveying sheets straight to a conveying path 46 which extends toward the image forming station. This intermediate sheet feeding mechanism 52 further includes a feed roller 47 for conveying the sheet in the opposite direction; an inverting portion 48 for inverting the sheet conveyed by feed roller 47; and an inverse conveyance path 49 which conveys the sheet, passing through inverting portion 48, to conveying path 46.

More specifically, intermediate sheet feeding mechanism 52 will transport the sheet through straight-through conveying path 45 and deliver it directly to conveying path 46 when an image is formed again on the same face of the sheet. When an image is formed on the reverse face of the sheet, the sheet will be temporarily guided to the straight-through conveying path 45 and then be reversed by feed roller 47 to be conveyed through inverting portion 48 and inverse conveyance path 49 to conveying path 46.

Accordingly, when an image is formed again on the face or the opposite face of a sheet, the sheet which has been sent out from fixing roller 39 is fed into branch path 44 by the function of path converting claw 43. From this branch path 44, the sheet is delivered out through straight-through conveying path 45 or inverse conveyance path 49, to conveying path 46.

Here, in a particular embodiment, intermediate sheet feeding mechanism 52 may have an intermediate tray or the like which temporarily accommodates the sheet with an image formed thereon. In this case, a sheet feeder portion for feeding the sheet to conveyance path 46 should be provided for the intermediate tray.

Manual paper feeder 51 has a feeding unit which includes a feeder tray 53 having a number of sheets stacked thereon; a pickup roller provided correspondingly for delivering the sheet stacked on feeder tray 53; and unillustrated feed and separation rollers for feeding the sheets that are delivered, one by one. The sheet which is fed passing through the feed roller and separation roller is then fed to the aforementioned resist roller 37. Arranged in the path to the entrance to the resist roller are a conveyer roller 54 and a detecting arm 56 for detecting the presence of a sheet being conveyed.

Further, paper feed cassette 50 can be provided in such a manner that it can be drawn out from the front side of the copier body and attached toward the rear side thereof, in FIG. 7. For paper feed cassette 50, the feeding mechanism on the copier side, comprising a pickup roller 57, a feed roller 58 for conveying the sheet delivered by pickup roller 57 to conveying path 46 and a separation roller 59 which is pressed against feed roller 58 with an appropriate pressure, is a type of sheet feeding device 5. Here, for manual paper feeder 51, feeder tray 53, unillustrated pickup roller, feed roller and separation roller etc., form its sheet feeding mechanism.

The First Embodiment of a Sheet Feeding Device

The sheet feeding device 5 of the invention will be explained before using an example of an automatic paper feeder having a paper feed cassette 50 shown in FIG. 7. As detailedly shown in FIG. 4, paper feed cassette 50 has a casing 60 for accommodating sheets thereon, in which the bottom of casing 60 functions as the stacking plate 61. Provided on stacking plate 61 are regulator plates 62 for constraining the sheets at both sides across the width, which is perpendicular to the paper feeding direction of sheet P; and a rear end regulator plate 63 for constraining the rear end of the sheets with respect to the sheet feed direction. Regulator plates 62 are provided so as to be movable across the width in accordance with the width of the sheets. Rear end regulator plate 63 is removably provided in order to position the rear end of the sheets with respect to the sheet feed direction in accordance with the size of the sheets, and attached at a position so as to regulate the rear end of the sheets.

The sheets are placed on the area enclosed by the above regulator plates 62 and 63 and constrained thereby at both sides and the rear end thereof. The sheet accommodating room partitioned by these regulator plates 62 and 63 corresponds to the size of the sheets to be accommodated, and there is a detection marking portion 64 indicating the size of the sheets accommodated, on the side to the rear, with respect to the insertion direction of paper feed cassette 50, or on the front side in FIG. 4. This detection marking portion 64 has detection markers 65 which can be placed or removed in accordance with the size of the sheets accommodated. Provided on the copier body, detectors (of micro switches etc.) corresponding to detachable detection markers 65 are arranged opposing detection marking portion 64. Accordingly, the detector corresponding to detection marker 65, is actuated so as to detect the size of sheets to be accommodated.

Casing 60 of paper feed cassette 50 has guide portions 66 on both sides thereof so that the cassette can be drawn out while the guide portions are slid on guide rails provided in the copier body. This structure may be configured to be of a well-known type, hence the detail will be omitted.

Inward face 67 (in the paper feed direction) of stacking plate 61 of paper feed cassette 50 is provided in the form of an upward slope so that the paper will be fed into the pressure nip between feed roller 58 and separation roller 59 as sectionally shown in FIG. 6. Provided on the surface of front face 67 are a plurality of projected ribs, as shown in FIG. 4, which reduce the frictional resistance with sheet P. A detector element 68 for detecting the presence of a stack of sheets P is provided on stacking plate 61 of casing 60 adjacent to sloped front face 67. This detector element 68 is depressed when sheets P are loaded and will operate the switch for detecting the fact that sheets P have been loaded.

Formed on the side of the detector of sheets P is a hollowed portion 69 to which a frictional separating member of the invention will be applied or mounted. This hollowed portion 69 receives a frictional separating member 70 of the invention. This hollowed portion 69 comprises a cavity for allowing the user to insert fingers etc., thereinto and easily remove frictional separating member 70, and a receptacle for receiving frictional separating member 70 therein.

Frictional separating member 70 is positioned in alignment with pickup roller 57 which is arranged corresponding to the inward portion, with respect to the sheet feed direction, of paper feed cassette 50, as shown in FIGS. 5 and 6. This frictional separating member 70 is provided on a flexible sheet-like support 71 for peeling removal in order to enable easy removal of frictional separating member 70. This flexible sheet-like support 71 has a handle 71*a* to be held by the fingers etc., and this handle 71*a* is positioned corresponding to the cavity portion for allowing fingers to be fitted therein, in hollowed portion 69.

Frictional separating member 70 is, for example, composed of a deformable portion 70*a* such as rubber, foam, sponge etc., and a portion 70*b*, applied to portion 70*a*, having a relatively large frictional coefficient on its surface in contact with sheet P. Frictional separating member 70 may be formed of a frictional portion 70*b* directly fixed to the aforementioned flexible sheet-like support 71.

Figure 8B:
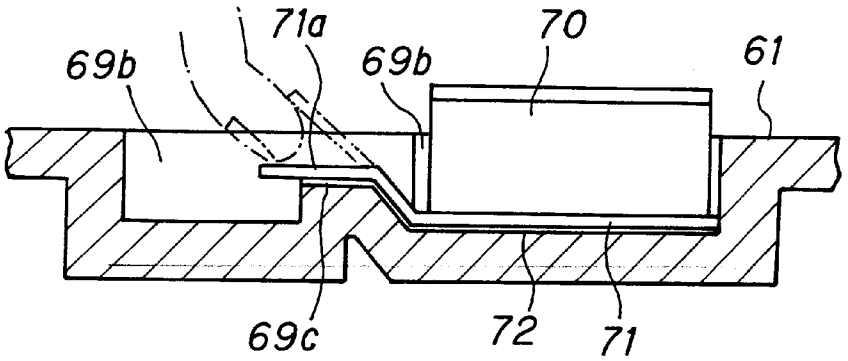
FIGS. 8A and 8B are illustrative views for illustrating a state and handling of the replacement of a frictional separating member in the first embodiment of a sheet feeding device of the invention.
Figure 8A:
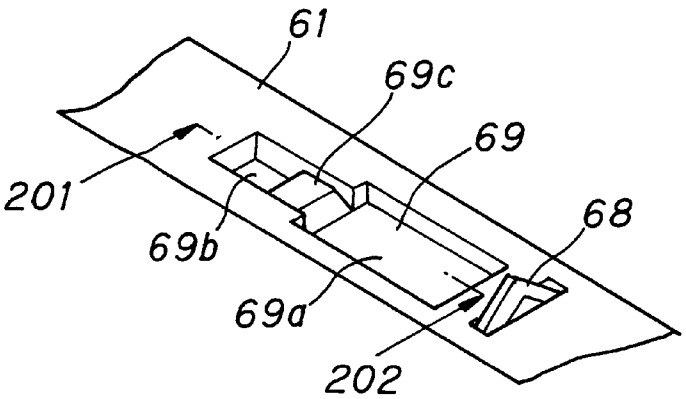

Referring to FIGS. 8A and 8B, the details of hollowed portion 69 and frictional separating member 70 of the first embodiment of the invention will be further described. In FIG. 8A, hollowed portion 69 positioned opposing pickup roller 57, in stacking plate 61 of casing 60, as shown in the figures, includes a receptacle cavity 69*a* for embedding frictional separating member 70*b*, a second cavity 69*b* where handle 71*a* of flexible sheet-like support 71 is placed. Formed between this receptacle cavity 69*a* and the second cavity 69*b* is a projected portion 69*c* which partitions the two cavities. This projected portion 69*c* is formed in such a way that its projected end will not extend above the level (surface) of stacking plate 61, but is formed inside hollowed portion 69.

As shown in FIG. 8B, which shows a sectional view taken along a plane 201–202 in FIG. 8A, adhesive 72 for fixing flexible sheet-like support 71 is applied on receptacle cavity 69*a* mounting frictional separating member 70 therein and projected portion 69*c*. This adhesive 72 is provided in order to hold flexible sheet-like support 71 on stacking plate 62, and may be formed of duplex adhesive tape etc. applied to flexible sheet-like support 71, in place of applying adhesive to receptacle cavity 69*a*.

In this configuration, when the feeding of paper is instructed, pickup roller 57 goes down so as to press the top of the stack of sheets P on stacking plate 61, as shown in FIG. 6. Then as pickup roller 57 rotates, the topmost sheet P is delivered. At this moment, frictional separating member 70 on stacking plate 61 stops the stack of sheets P from being conveyed by pickup roller 57 to feed roller 58, so that only the topmost sheet P will be delivered out. In this case, if a plurality of sheets P was delivered to feed roller 58, the lower sheets P are stopped by the action of separation roller 59, and only the topmost sheet P will be fed.

When the function of frictional separating member 70 has been degraded after the repetition of the feeding operations, replacement of the frictional separating member 70 is indicated. In accordance with this indication, the user or the maintenance person draws paper feed cassette 50 from the copier body. If there are sheets P stacked on stacking plate 61, the sheets P should be taken out. Then, in order to peel off the exposed frictional separating member 70, the user inserts a finger etc. into the second cavity 69*b* in hollowed portion 69 as shown in FIG. 8B so as to pick handle 71*a* of flexible sheet-like support 71 and peel off the support 71 from receptacle cavity 69*a* of hollowed portion 69. During this operation, because handle 71*a* is adapted not to be stuck to the second cavity 69*b* with adhesive etc., it can be easily held by the fingers so that flexible sheet-like support 71 can be pulled off from receptacle cavity 69*a* of hollowed portion 69.

In this case, since projected portion 69*c* provided partitioning receptacle cavity 69*a* and the second cavity 69*b* is formed in a slanted manner, this configuration further facilitates the peeling action of support 71. Further, since the provision of projected portion 69*c* keeps handle portion 71*a* of support 71 free within the second cavity 69*b,* it is possible to hold handle 71*a* more easily.

As flexible sheet-like support 71 is stripped in the manner stated above, frictional separating member 70 provided on support 71 can be taken off. Then flexible sheet-like support 71 with a fresh frictional separating member 70 fixed thereon may and should be applied to receptacle cavity 69*a* of hollowed portion 69. In this case, if adhesive 72 is of a recycle-able type, meaning that the stickiness will last, there is no need to newly apply adhesive 72. If adhesive 72 is of a curing type, adhesive 72 must be removed using a solvent etc., and then fresh adhesive 72 should be applied. Further, if adhesive 72 is a type which has been previously provided on the underside of flexible sheet-like support 71 and can be removed when sheet-like support 71 is stripped off, the replacement can be done by only application and fixing of a new sheet-like support 71 already having adhesive 72, to receptacle cavity 69*a* of hollowed portion 69. For adhesive 72, duplex tape etc. can also be used.

As has been explained heretofore, the replacement action of frictional separating member 70 can be markedly simplified, so that it is possible for the user to replace it in place of a maintenance person.

Figure 9B:
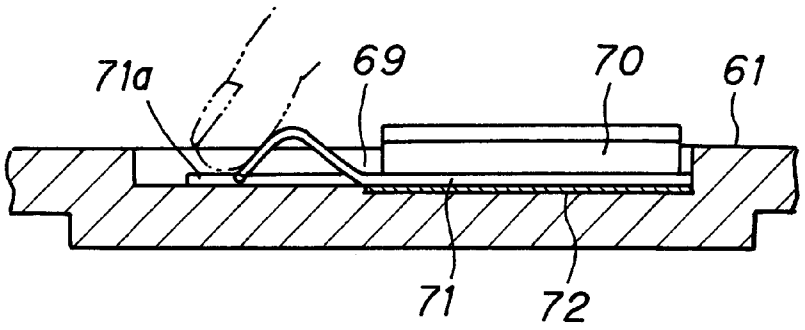
FIGS. 9A and 9B are illustrative views for illustrating another state and handling of the replacement of a frictional separating member in the first embodiment of a sheet feeding device of the invention.
Figure 9A:
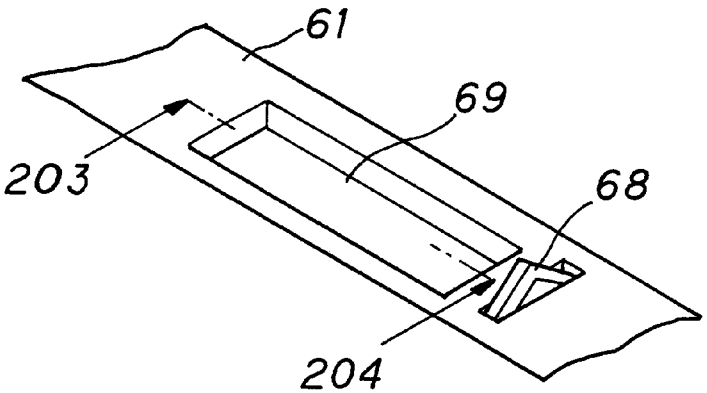

The arrangement of this embodiment is not to be limited to the configuration shown in FIGS. 8A and 8B, but can be configured as shown in FIGS. 9A and 9B. Illustratively, in the configuration shown in FIG. 9A, instead of providing a partition for the cavities in hollowed portion 69, hollowed portion 69 is configured with an integrated cavity. In this arrangement, as shown in FIG. 9B which is the sectional view taken on the plane 203–204 in FIG. 9A, adhesive 72 is applied to the area, opposing frictional separating member 70, on the bottom of hollowed portion 69, so that sheet-like support 71 is adhesively adhered. Handle portion 71*a* of flexible sheet-like support 71 is not adhered, being just placed freely on the bottom of hollowed portion 69.

Also in this case, a finger, etc. is inserted into the cavity of hollowed portion 69 where no frictional separating member 70 exists so as to easily flex handle portion 71*a* of flexible sheet-like support 71. Thus, sheet-like support 71 can be easily stripped off from hollowed portion 69. The attachment of a fresh frictional separating member 70 after the removal can be performed in the same as described above.

Figure 10B:
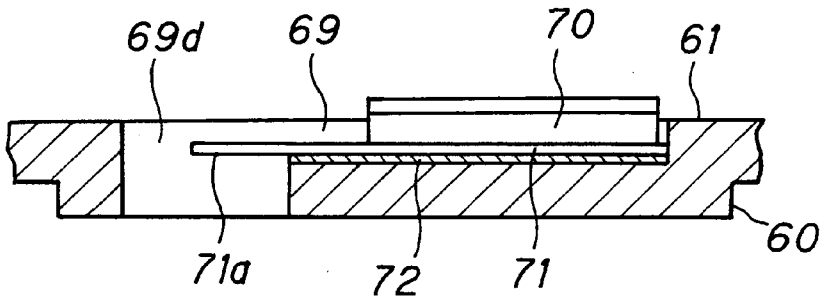
FIGS. 10A and 10B are illustrative views for illustrating a further state and handling of the replacement of a frictional separating member in the first embodiment of a sheet feeding device of the invention.
Figure 10A:
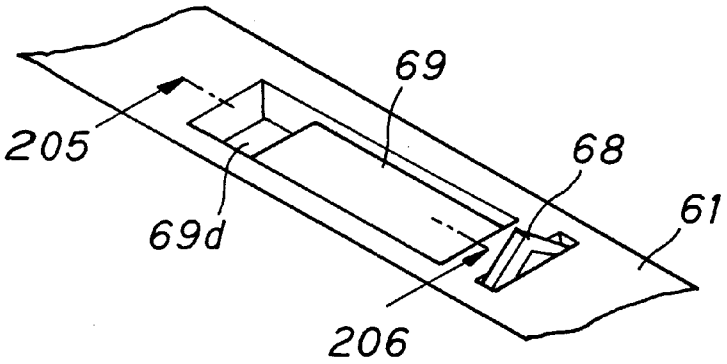

FIGS. 10A and 10B show a configuration in which flexible sheet-like support 71 can be stripped off in a more simplified manner. As shown in FIG. 10A, hollowed portion 69 to which frictional separating member 70 is mounted is provided with a passage hole 69*d* in the area corresponding to handle portion 71*a* of flexible sheet-like support 71. Therefore, as shown in FIG. 10B which is a sectional view taken along plane 205–206 in FIG. 10A, flexible sheet-like support 71 can be readily held by the fingers etc., at handle portion 71*a* thereof which is located corresponding to passage hole 69*d.* As result, the peeling of flexible sheet-like support 71 can be further simplified.

Figure 11:
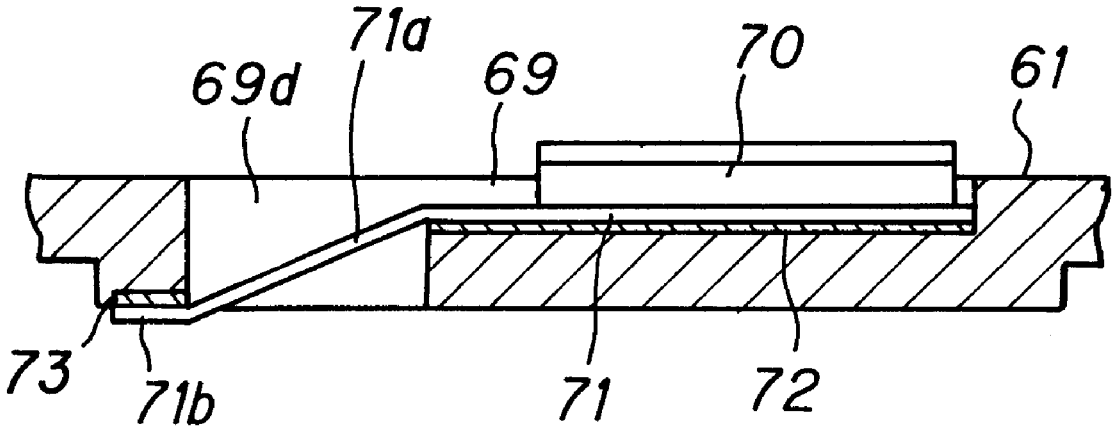
FIG. 11 is an illustrative view for illustrating a still another state and handling of the replacement of a frictional separating member in the first embodiment of a sheet feeding device of the invention.

In FIGS. 10A and 10B, handle portion 71*a* of flexible sheet-like support 71 is configured in the form of a free end. Therefore, there is a risk that the handle portion might project above the stacking surface of sheets P, due to deformation or other defects. In general, sheet-like support 71 is formed of a friction-free material which will not inhibit sheet delivery and feeding. However, if there is a concern that sheets P being conveyed will stick and hence fail to be transported, handle portion 71*a* is extended longer so that its distal end 71*b* is fixed with adhesive 73 to the undersurface of stacking plate 62 as shown in FIG. 11, in place of being formed of a free end.

By this configuration, handle portion 71*a* of sheet-like support 71 will not project out above the sheet path surface, and hence will not interfere with the sheet conveying action. When frictional separating member 70 is replaced, distal end 71*b* of handle portion 71*a* is detached from the undersurface of stacking plate 62 so that sheet-like support 71 can be readily removed by holding handle portion 71*a.* In this case, the peeling action of sheet-like support 71 can be made easier because handle portion 71*a* is longer. To make distal end 71*b* of handle portion 71*a* fixed, the distal end may also be tacked by glue or tacky agent 73 instead of using a strong adhesive. This facilitates simple removal of distal end 71*b.*

Figure 12B:
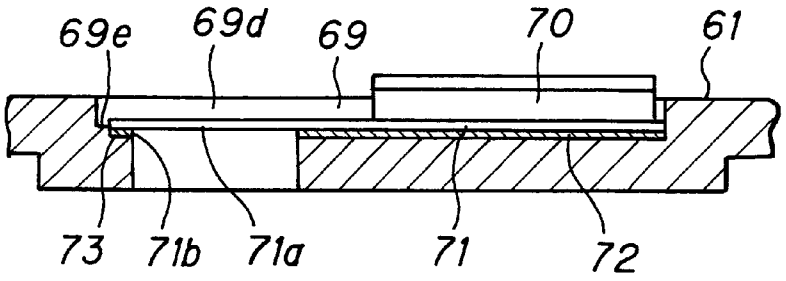
FIGS. 12A and 12B are illustrative views for illustrating a still further state and handling of the replacement of a frictional separating member in the first embodiment of a sheet feeding device of the invention.
Figure 12A:
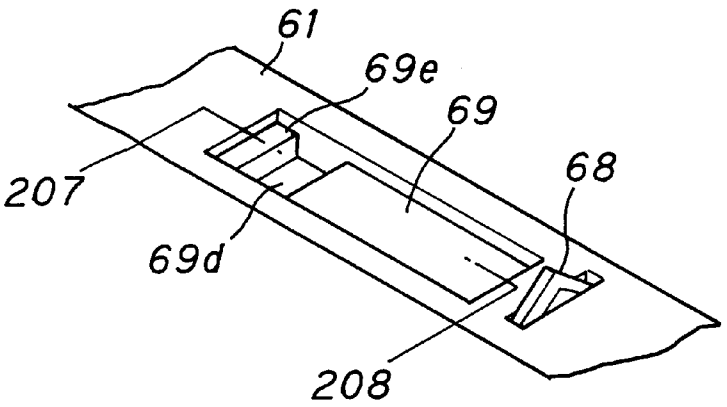

FIGS. 12A and 12B show another modification of that shown in FIGS. 10A and 10B, and illustrates another embodiment in which distal end 71*b,* to be a free end of handle portion 71*a* of sheet-like support 71, is adhesively held. Illustratively, a stepped portion 69*e* for adhesively holding the distal end is provided within hollowed portion 69, adjacent to passage hole 69*d* located corresponding to handle portion 71*a.* This stepped portion 69*e* adhesively holds distal end 71*b* of handle portion 71*a* with adhesive 73. In this configuration also, free movement of handle portion 71*a* is constrained so that it is possible to completely eliminate the cause of feeding failures of sheets due to the projection of distal end 71*b* above the sheet conveying surface.

Second Embodiment

In the embodiment described above, the bottom of casing 60 constituting paper feed cassette 50 is configured by stacking plate 61 while hollowed portion 69 having frictional separating member 70 embedded therein is provided with flexible sheet-like support 71 adhering to hollowed portion 69 with adhesive 72 to hold it. In this case, the hollowed portion 69 has an area for accepting handle portion 71*a* of sheet-like support 71. This area for receiving handle portion 71*a* needs hollowed portion 69 to be of greater width with respect to the sheet.

There are some cases, however, where it is impossible to provide the area (the second cavity), for receiving handle portion 71*a,* extending across the width of a sheet, within the hollowed portion 69. For example, it may be impossible to provide the cavity when a detector element 68 needs to be provided for detecting the presence of sheets P loaded on stacking plate 61.

In such a case, an area which corresponds to the second cavity 69*b* of hollowed portion 69 for receiving frictional separating member 70 illustrated in the first embodiment, can be provided in the feed direction of sheet P. Accordingly, in the embodiments shown at FIGS. 8A and 8B through FIGS. 12A and 12B, the area for receiving handle portion 71*a* was formed extending in the direction of the width of sheet P. On the contrary, it is effective to provide this area in the paper feed direction of sheet P when there is no available space in the direction of the width of sheet P.

Figure 13:
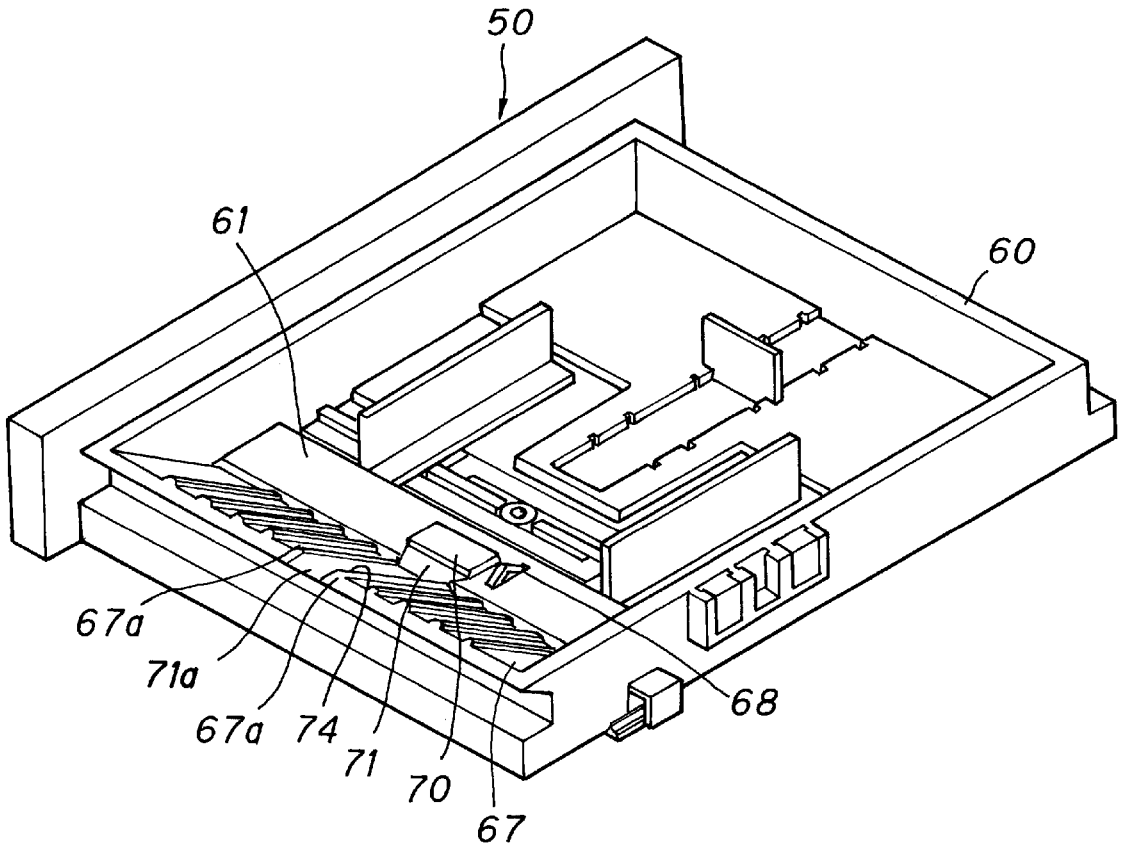
FIG. 13 is a perspective view showing a paper feed cassette in the second embodiment of a sheet feeding device of the invention.

The embodiment shown in FIG. 13, is configured in such a way that inward face 67, in the sheet feed direction, of casing 60 of paper feed cassette 50 is shaped in the form of a slope with a plurality of projected ribs 67*a* on face 67 for reducing friction against sheet P when it is guided. While, handle portion 71*a* of flexible sheet-like support 71 having frictional separating member 70 fixed thereon is placed and kept in a trough between projection ribs 67*a*.

Figure 14:
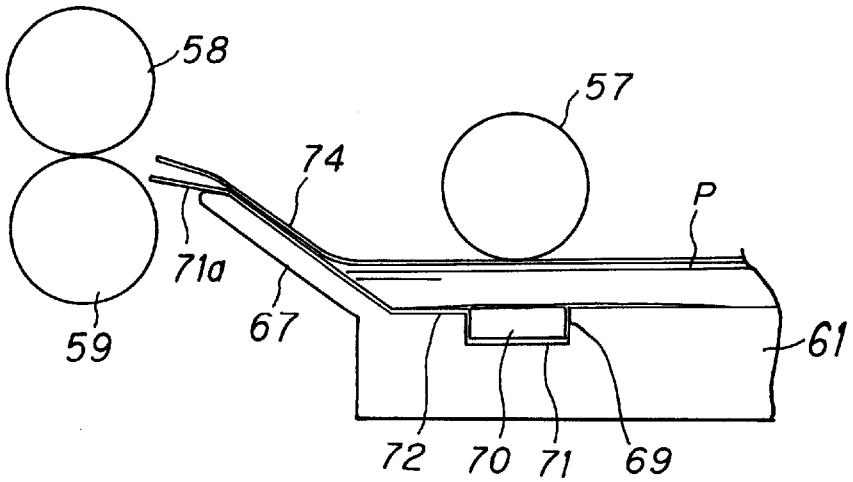
FIG. 14 is a sectional view showing the sheet feeding portion including the sheet feeding means such as a pickup roller etc. shown in FIG. 13.

As sectionally shown in FIG. 14, flexible sheet-like support 71 having frictional separating member 70 thereon is adhesively fixed with adhesive 72 to hollowed portion 69 located corresponding to pickup roller 57. Flexible sheet-like support 71 is extended in the paper feed direction, to the area with a trough 74 (depressed portion) formed between projecting ribs 67*a* on inward face 67 of casing 60 constituting paper feed cassette 50 with its tip reaching near the pressure nip between feed roller 58 and separation roller 59. In particular, sheet-like support 71 is adhesively attached to inward face 67 in trough 74 with adhesive 72. The front end of flexible sheet-like support 71 is projected over inward face 67, as a free end, forming handle portion 71*a*.

Since flexible sheet-like support 71 is also adhesively held with adhesive 72 to an area of inward face 67 of casing 60, that is, since sheet-like support 71 is adhesively adhered to a wider area besides the area of hollowed portion 69, it can be held fast.

In the configuration described heretofore, pickup roller 57 goes down to press the topmost sheet P and delivers out sheet P. During this action, frictional separating member 70 holds the stack of sheets P on the stacking plate 61, and only the topmost sheet P is delivered out by the rotation of pickup roller 57. The sheet P is guided by projection ribs 67*a* upward along the slope of inward face 67 so as to be fed into the pressure nip between paper feed roller 58 and separation roller 59.

The sheet P is guided by handle portion 71*a* of sheet-like support 71 having frictional separating member 70 fixed thereon, toward the nip between the aforementioned rollers. In this way, the handle portion 71*a* also functions as a guide for guiding sheet P.

When frictional separating member 70 has been used for a prolonged period of time, feeding failures of sheets frequently occur due to the decrease of the frictional coefficient. Before such events happen, this frictional separating member 70 should and may be replaced. This can be done by holding the free end, i.e., handle portion 71*a* and stripping it off from the adhered surface of flexible sheet-like support 71. Then flexible sheet-like support 71 having a fresh frictional separating member 70 fixed thereon is placed and adhesively adhered to the position where the previous one had been located. This attachment is performed in the same manner as described in the first embodiment.

Other Embodiments

In the above configuration, hollowed portion 69 for embedding frictional separating member 70 in stacking plate 61 is formed in the bottom plate of casing 60, in order to accommodate sheets P in casing 60 of paper feed cassette 50. In this case, stacking plate 61 can be formed with casing 60 by integral molding of resin etc., therefore, hollowed portion 69 can be formed easily, while stacking plate 61 has a certain thickness needed for forming the hollowed portion.

Figure 1:
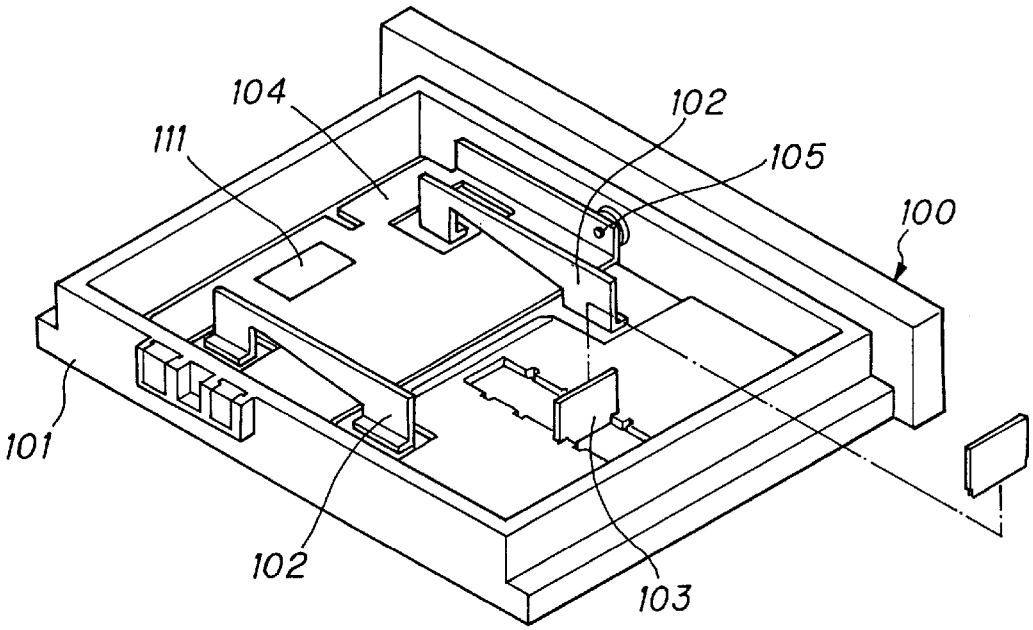
FIG. 1 PRIOR ART
FIG. 1 is a perspective view showing a paper feed cassette for illustrating a conventional sheet feeding device.
Figure 2:
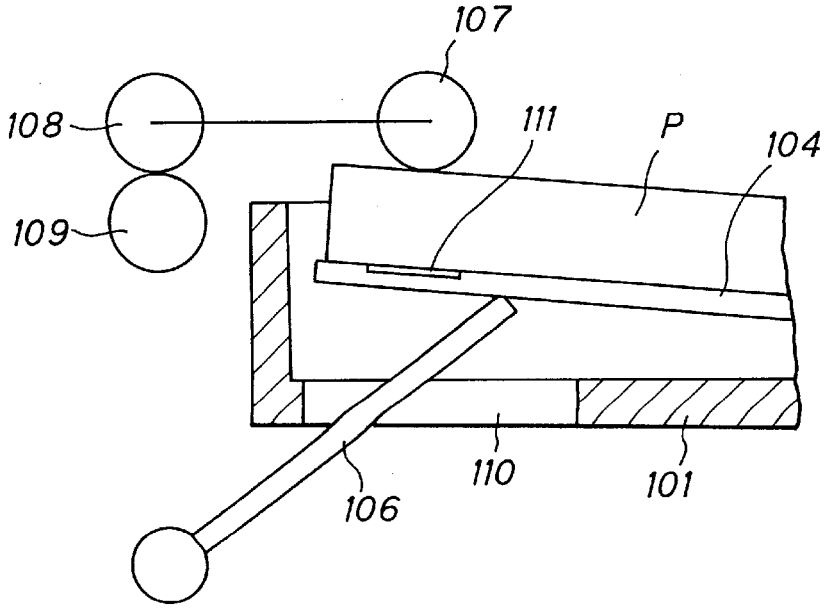
FIG. 2 PRIOR ART
FIG. 2 is a sectional view showing a configuration including the sheet feeding means shown in FIG. 1.
Figure 3:
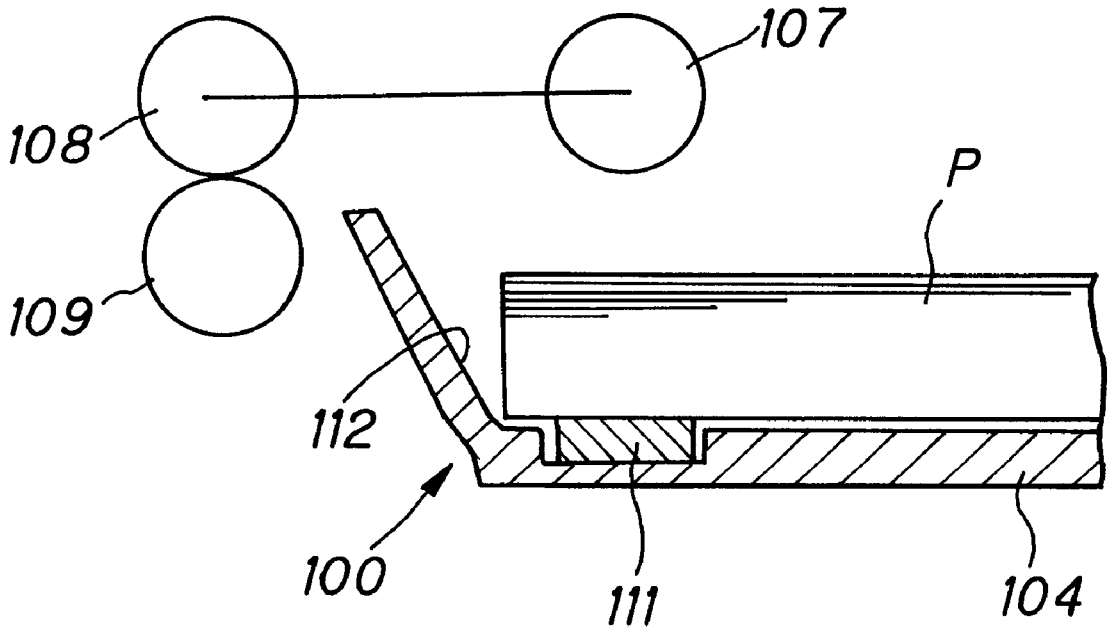
FIG. 3 PRIOR ART
FIG. 3 is a sectional view showing another example of a paper feed cassette for illustrating a conventional sheet feeding device.

However, as shown in FIG. 1, in stacking plate 104 (61) which is supported pivotally within casing 101(60) of paper feed cassette 100(50), there is no room for forming a hollowed portion. Specifically, this pivotal stacking plate 104 is formed of a thin metallic plate, which cannot be provided with hollowed portion 69.

Figure 15B:
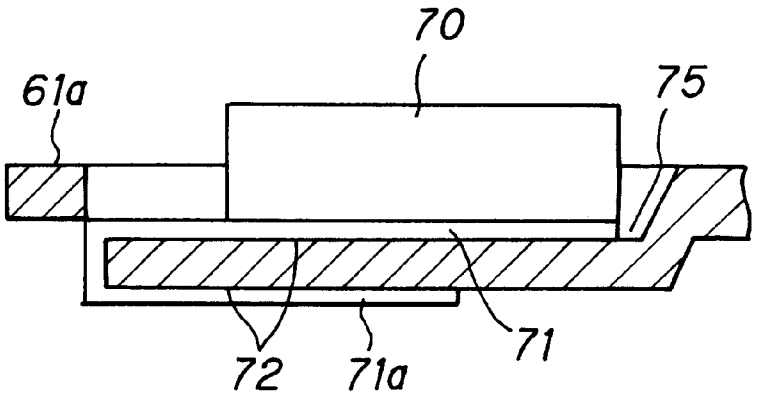
FIGS. 15A and 15B are illustrative views for illustrating a further embodiment of a sheet feeding device of the invention.
Figure 15A:
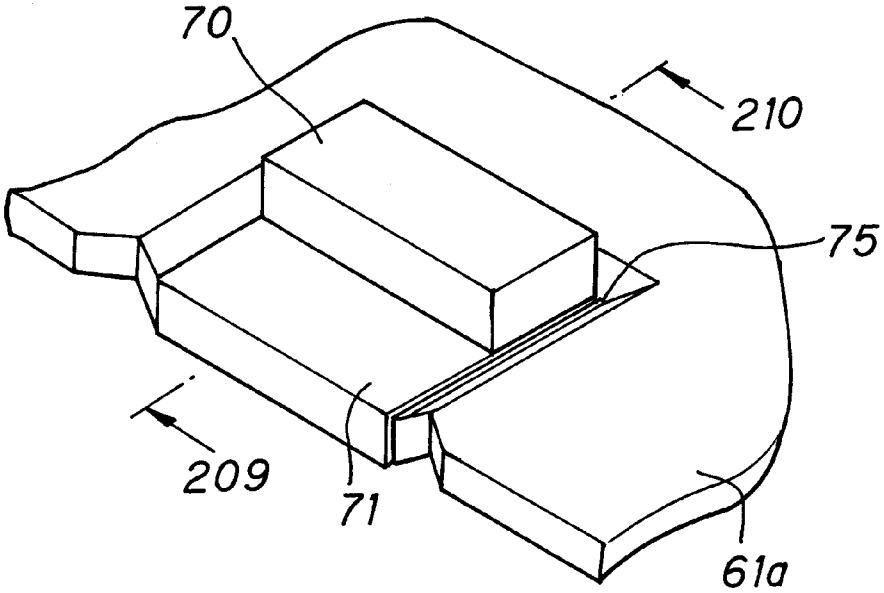

To deal with this situation, as shown in FIGS. 15A and 15B, in a stacking plate 61*a* which is provided pivotally within paper feed cassette 50, a stepped portion 75 which is depressed from the level of the sheet stacking surface, is formed at the front end, in particular, in the area corresponding to pickup roller 57. In this arrangement, a flexible sheet-like support 71 having a frictional separating member 70 fixed thereon is adhesively attached to this stepped portion 75 with adhesive 72.

As shown in FIG. 15B which is a sectional view cut along a plane 209–210 in FIG. 15A, this flexible sheet-like support 71 is adhesively held with adhesive 72, extending to the undersurface of stepped portion 75, while its distal end, i.e., handle portion 71*a* is not adhesively held, forming a free end. Since this handle portion 71*a* is located along the undersurface of stacking plate 61*a* as shown in the drawing, it will never interfere with the sheet feeding action from a stack of sheets P. Further, since sheet-like support 71 is adhesively attached to the undersurface, it will not peel off during the sheet feeding action, so that frictional separating member 70 will be held at the predetermined position.

Figure 16B:
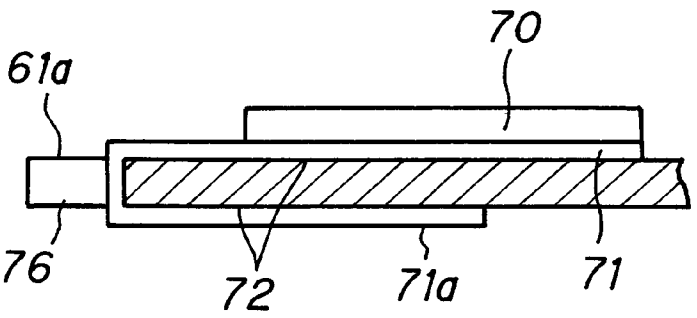
FIGS. 16A and 16B are illustrative views for illustrating still another embodiment of a sheet feeding device of the invention.
Figure 16A:
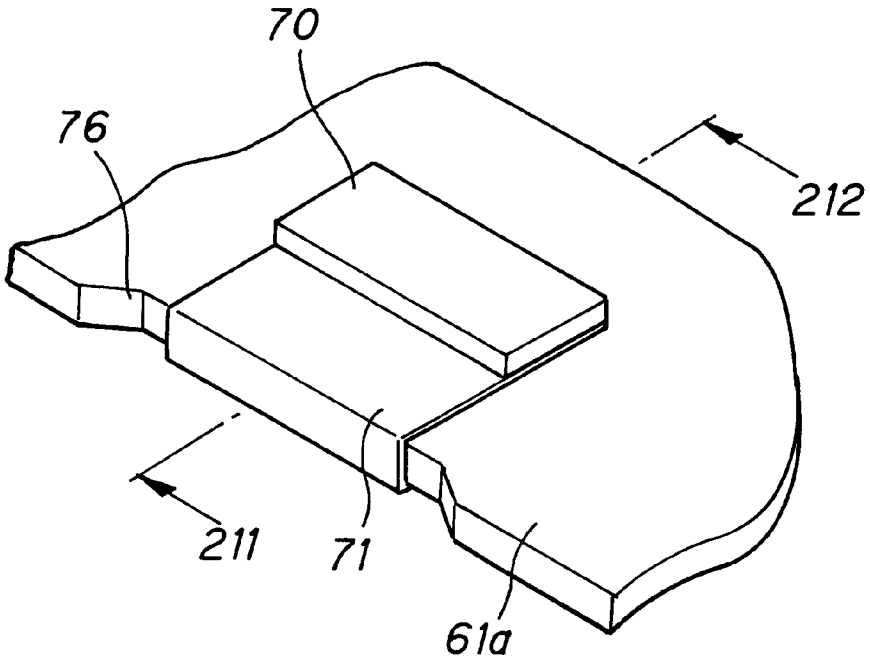

FIGS. 16A and 16B show a configuration in which sheet-like support 71 is held directly on the surface of stacking plate 61*a,* without use of a stepped portion 75 in stacking plate 61*a.* In particular, formed at the front end, of stacking plate 61*a,* corresponding to pickup roller 57 is a cutout, at which flexible sheet-like support 71 having frictional separating member 70 fixed thereon is folded and fixed.

More specifically, a partial cutout 76 is shaped in the front part of stacking plate 61*a* which is pivotally provided as shown in FIG. 16A. This cutout 76 is located corresponding to pickup roller 57 as stated above.

As shown in FIG. 16B which is a sectional view taken on a plane 211–212 in FIG. 16A, flexible sheet-like support 71 having frictional separating member 70 fixed thereon is adhesively held with adhesive 72. In particular, adhesive 72 is not only on the surface of stacking plate 61*a* but also spreads to the undersurface. Accordingly, flexible sheet-like support 71 is folded to the underside of stacking surface 61*a* along the edge of the cutout 76 so as to be adhesively held thereon. Further, handle portion 71*a* which is not adhesively held with adhesive is formed as a free end.

In this case, instead of providing stepped portion 75 for stacking plate 61*a,* cutout 76 is formed so as to not only serve as a marker for the holding position of frictional separating member 70, but also to serve as the positioning portion for adhesively holding flexible sheet-like support 71. Further, the provisions of cutout 76 makes the task of folding sheet-like support 71 easier, allowing the operator to insert fingers etc. to adhesively apply sheet-like support 71 to the underside of the plate. Other effects of this embodiment are the same as that described with reference to FIGS. 15A and 15B.

As stated heretofore, the sheet feeding device of the invention is, at least, adapted to hold a frictional separating member 70 easily replaceable, at the position corresponding to pickup roller 57 as the feeding means for delivering sheet P from a stack of sheets. Each embodiment of this device was described using the example of paper feed cassette 50 in a copier shown in FIG. 7. The application, however, should not be limited to feeder cassette 50. In practice, in manual feeder tray 53 at manual paper feed portion 51, a stack of sheets P is loaded thereon so that sheets are delivered one by one. Therefore, each of the above embodiments described can be applied to a manual feeder tray 53 by attaching frictional separating member 70 thereto.

When a large number of sheets P need to be loaded, a paper feeding tray, not the manual feeder tray, is provided in place of paper feed cassette 50. This paper feeding tray is controlled so as to be move up and down in accordance with the stacked amount of sheets P so that the top of the stack of sheets P is constantly at the predetermined height. Such a paper feed tray also needs the frictional separating member 70, and the invention described above which allows easy replacement of frictional separating member 70 can be applied thereto as it is.

Further, the present invention can also be applied to the portion mentioned as intermediate sheet feeding mechanism 52. Illustratively, intermediate feeding mechanism 52 may in some cases, have an intermediate tray or the like for temporarily holding the sheet with an image formed thereon. The sheet held on this intermediate tray needs to be delivered again to the image forming position. For this purpose, frictional separating member 70 with sheet-like support 71 of the invention may be applied to the intermediate tray, so as to facilitate easy replacement.

The present invention can be applied without change to an automatic document feeder 1 for performing automatic feeding of sheet-like original in the copier, in place of sheets P for print. In this case, sheet documents are stacked on a document stacking tray 11 in FIG. 7. The frictional separating member 70 having a flexible sheet-like support 71 fixed thereon in accordance with the invention can be used at the inward side of document stacking tray 11, thus facilitating easy replacement of frictional separating member 70.

In the sheet feeding device for feeding sheet P for printers, facsimile machines or the like other than copiers, frictional separating member 70 of the invention can be applied to the portion where a stack of sheets P is loaded. The present invention can be applied in the same manner regardless of the configuration of stacking plate 61 for stacking sheets P, either it is a fixed, pivotal or lifting type which allows the tray to move vertically.

In the sheet feeding device described above, in order to enable easy replacement of the frictional separating member for stabilizing sheet feeding, the frictional separating member is fixed on a sheet-like support which is held on the stacking plate or the like while a handle portion is to be a free end provided for the other end of the support. Accordingly, it is possible to easily strip off the frictional separating member thus sustained and quickly replace it with a fresh one.

In the case where the frictional separating member is mounted into a hollowed portion, a cavity is formed which allows fingers etc. to be inserted to the hollowed portion and a handle portion of the sheet-like support to be located in the cavity, thus facilitating the operator to strip off the support more easily. In this way, providing the hollowed portion enables more exact positioning of the frictional separating member. Further, the combination of the cavity and handle establishes easy replacement of the frictional separating member even if it is embedded in the depressed portion.

When the sheet-like support is adapted to extend in the sheet feeding direction, it is possible to attain a more assured holding, thus preventing the frictional separating member from peeling off during feeding operations.

Moreover, since the sheet-like support is folded to the undersurface of the stacking plate, the handle portion will no longer come out, and hence will never interfere with the sheet feed path. In particular, when the support is adapted to be extended and retained to the undersurface, the support will not be peeled off during feeding of sheets.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet feeding device comprising:

a stacking plate a frictional separating member for preventing a multiple number of stacked sheets from being fed together in a feeding unit, the separating member being disposed in the stacking plate on which a stack of sheets is loaded for delivery; and a sheet-like support for fixing the frictional separating member and retaining said separating member at a correct position on the stacking plate, wherein the support has a handle portion to be a free end which is not held on the stacking plate.

2. The sheet feeding device having a frictional separating member according to claim 1, further comprising a hollowed portion having a receptacle cavity for embedding the frictional separating member and a cavity for placing the handle portion to be a free end therein is provided in the stacking plate.

3. The sheet feeding device having a frictional separating member according to claim 2, wherein the hollowed portion has a projected portion which partitions the receptacle of the frictional separating member and the portion in which the handle portion is positioned so that the handle portion juts out over the projected portion.

4. The sheet feeding device having a frictional separating member according to claim 2, wherein the hollowed portion has a passage hole in the area where the handle portion of the sheet-like support is positioned, and the handle portion is adhesively retained in the hollowed portion or the undersurface of the stacking plate in order to constrain the movement of a distal end of the handle portion.

5. A sheet feeding device comprising:

a stacking plate a frictional separating member for preventing a multiple number of stacked sheets from being fed together in a feeding unit, the separating member being disposed in the stacking plate on which a stack of sheets is loaded for delivery; and a sheet-like support for fixing the frictional separating member and retaining it at a correct position on the stacking plate, wherein the sheet-like support is extended up to a vicinity of a feeding unit which further feeds the delivered sheet in the sheet feeding direction, and an extended end is formed to be a handle portion as a free end which is not held on the stacking plate.

6. The sheet feeding device having a frictional separating member according to claim 5, wherein an extended portion of the sheet-like support is held in a trough between projection ribs formed in an inward-side face for guiding the fed sheet.

7. A sheet feeding device comprising:

a stacking plate a frictional separating member for preventing a multiple number of stacked sheets from being fed together in a feeding unit, a separating member being disposed in an stacking plate on which a stack of sheets is loaded for delivery; and a sheet-like support for fixing the frictional separating member and retaining it at a correct position on the stacking plate, wherein the sheet-like support is extended in the sheet feeding direction so that the extended portion is folded at a front edge of the stacking plate and retained also by the undersurface of the stacking plate while the distal end of the extended portion is formed to be a handle portion of a free end which is not held on the stacking plate.

8. The sheet feeding device having a frictional separating member according to claim 7, wherein the front edge of the stacking plate at which the sheet-like support is folded is formed with a cutout.

* * * * *